United States Patent [19]

Weisgerber

[11] 3,935,814

[45] Feb. 3, 1976

[54] SHEET DELIVERY APPARATUS

[75] Inventor: Willi Weisgerber, Johannisberg-Rheingau, Germany

[73] Assignee: Miller Printing Machinery Co., Pittsburgh, Pa.

[22] Filed: Feb. 19, 1974

[21] Appl. No.: 443,430

[30] Foreign Application Priority Data

Feb. 19, 1973 Germany ..... 2308025

[52] U.S. Cl. ..... 101/232; 101/409; 271/277

[51] Int. Cl.² ..... B41F 21/08

[58] Field of Search ..... 101/232, 233, 409–411; 271/202, 205, 270, 277

[56] References Cited

UNITED STATES PATENTS

| | | | |
|---|---|---|---|
| 1,614,940 | 1/1927 | Wright | 271/203 |
| 2,374,668 | 5/1945 | Davidson | 101/232 |
| 2,734,454 | 2/1956 | Pabst et al. | 101/409 |
| 2,767,790 | 10/1956 | Jacobson et al. | 101/232 |
| 2,831,426 | 4/1958 | Schunemann | 101/232 |
| 2,940,387 | 6/1960 | Pritchard | 101/232 |
| 3,642,274 | 2/1972 | Herrington et al. | 271/277 |
| 3,719,267 | 3/1973 | Reist et al. | 271/202 |
| 3,831,932 | 8/1974 | Conrad | 271/203 |
| 3,832,994 | 9/1974 | Koerner et al. | 101/232 |

*Primary Examiner*—Edgar S. Burr
*Assistant Examiner*—William Pieprz
*Attorney, Agent, or Firm*—Stanley J. Price, Jr.

[57] ABSTRACT

In a sheet fed printing press the sheet delivery apparatus includes a delivery drum positioned adjacent to an impression cylinder of the printing press. The delivery drum has a shaft journaled in the press frame with a pair of delivery sprockets connected the shaft on opposite sides of the delivery drum for rotation therewith. Endless delivery chains are reeved about the sprockets and have a plurality of transversely extending gripper bars secured therebetween in spaced relation to each other. The delivery drum has a recessed portion arranged to receive the gripper bars as the gripper bars revolve about the shaft with the delivery drum. The delivery sprockets have a pitch diameter equal to the diameter of the delivery drum so that the speed of the gripper bars is equal to the peripheral speed of the delivery drum as the gripper bar revolves about the shaft and the speed of the front edge of the sheet is the same as the speed of the trailing edge portion of the sheet until the trailing edge portion leaves the nip between the impression and blanket cylinder of the printing press. Means are provided to adjust the height of the grippers on the gripper shaft to adjust for different thicknesses of the sheets passing through the press. The adjustment means is arranged to adjust the gripper bar with the grippers thereon beyond the periphery of the delivery drum to engage relatively thin sheets and to reduce the height of the gripper bars to the radial dimension of the delivery drum to accommodate sheets having a substantial thickness. Other means are provided to change the angular velocity of the delivery drum and the sprockets connected thereto so that the speed of the gripper bar and the front edge of the sheet is the same as the peripheral speed of the impression cylinder until the trailing edge of the sheet leaves the nip between the impression cylinder and blanket cylinder of the printing unit.

4 Claims, 10 Drawing Figures

SHEET DELIVERY APPARATUS

BACKGROUND OF THE INVENTION

1. Field of the Invention

This invention relates to a sheet delivery apparatus and more particularly to sheet delivery apparatus wherein the pitch diameter of the delivery sprockets is equal to the diameter of the delivery drum.

2. Description of the Prior Art

In the transfer of freshly printed sheets from the printing unit to the delivery apparatus it is essential during delivery that the linear velocity of the sheet remain the same until the trailing edge of the sheet has passed through the nip or tangent point between the blanket and impression cylinder. If the speed of the sheet decreases a curl forms in the trailing edge portion of the sheet and if the speed increases undue tension is exerted on the sheet that results in smearing and streaking of the freshly printed ink.

Conventional sheet delivery apparatus includes a cylindrical sheet supporting means such as a delivery drum or spaced discs on which the sheet is supported as it is transferred from the impression cylinder to the delivery apparatus. A pair of endless chains are reeved about drive sprockets that are nonrotatably mounted on the same shaft that rotatably supports the delivery drum. Gripper bars are secured to the endless chains and extend transversely therebetween. The delivery drum has a recessed portion to receive the gripper bars so that the grippers positioned thereon engage the front edge of the sheet transferred from the impression cylinder. As the front edge of the sheet is engaged by the grippers on the transverse gripper bars the trailing portion of the sheet remains between the printing and blanket cylinder of the printing unit and one side of the trailing edge portion of the sheet is being printed by the ink impression on the blanket cylinder.

It is essential to eliminate smearing of the ink or a curl in the trailing edge of the sheet that the linear speed of the entire sheet remain the same until the trailing edge of the sheet has passed between the nips of the impression and blanket cylinder. Where the linear velocity of the sheet front edge is reduced below the linear velocity of the sheet trailing edge portion the sheet trailing edge portion adheres to the ink on the blanket cylinder because of the ashesive qualities of the ink and forms a curl in the trailing edge portion of the sheet similar to a curl obtained by passing the trailing edge of the sheet over a knife edge. Where the velocity of the trailing edge of the sheet is less than the linear velocity of the sheet front edge portion undue tension is exerted on the sheet that results in smearing of the freshly printed surface. Further, it is highly desirable to provide a smooth, straight path for the sheet after it passes around the delivery drum to eliminate fluttering of the sheet as it is delivered to the stack.

In conventional sheet delivery apparatus the delivery chain sprockets have a pitch diameter substantially smaller than the diameter of the sheet delivery drum and the sheet delivery drum, in turn, because of the different thickness of the sheets that can be printed in the printing press, has a diameter smaller than the diameter of the press impression cylinder. To compensate for sheet thickness, the gripper bar may be adjusted linearly relative to the diameter of the sheet supporting drum to engage sheets of different thickness as they are transferred from the impression cylinder.

Where the gripper bar is adjusted beyond the periphery of the delivery drum it has a peripheral velocity greater than the velocity of the delivery drum because of the increased radius of the gripper bar over the radius of the delivery drum. The increased radius increases the speed of the gripper bar as it revolves about the delivery sprockets and exerts an increased tension on the sheet and results in smearing and streaks in the freshly printed ink on the sheet. Remedies, such as gluing foam rubber on parts of the delivery apparatus, do not completely eliminate these deficiencies. Further, the installation of supporting discs, spur gears, helical springs, sand paper strips, foam rubber and the like require considerable space and maintenance.

Where the pitch diameter of the chain sprockets is substantially less than the diameter of the delivery drum the sheet is transferred from the printing unit around the sheet supporting delivery drum at a velocity below the velocity of the sheet transferred by the impression cylinder. This results in the trailing edge of the sheet moving faster than the front edge of the sheet and results in a severe curling of the trailing edge of the sheet after it passes between the nip of the impression and blanket cylinder and before it is supported by the sheet supporting delivery drum.

There is a need for sheet delivery apparatus that maintains the velocity of the sheet as it is transferred from the printing unit to the delivery unit at substantially the same velocity as the sheet is conveyed by the impression cylinder within the printing unit. There is also a need for sheet delivery apparatus that minimizes the change in direction of the sheet as it leaves the circular path around the delivery drum that causes fluttering of the sheet. In the past guides, baffle plates, bands and the like have been used with limited success.

German Patent Application OLS 2,111,049, published and not examined, discloses a sheet delivery apparatus which compensates for the change in the speed of the sheet as it is delivered to the delivery apparatus. This apparatus includes delivery sprockets that have a considerably smaller diameter than the diameter of the delivery drum. The considerable difference in the speed effected by this difference in diameter is compensated by moving a segment of the sprocket to compensate for the different in radius. The disadvantage of this embodiment is that the segment does not revolve and the danger of smearing the wet ink still exists. In another embodiment, a gear is provided in which a double link is periodically shortened and lengthened by a cam to compensate for the existing difference in the speed. This gear only corrects a definite difference in the speed in case of a fixed height of the gripper pad. Where the height of the delivery grippers is changed for different thicknesses of paper, resultant differences in speed of the sheet are encountered. Further, a relatively high play in the gear results from the double link arrangement so that even this correction is not adequate for accurate speed control.

German Patent No. 2,026,355 has also disclosed apparatus in which a stationary drum is provided on the sprocket shaft between the pair of sprockets. This stationary drum has a porous covering through whch compressed air flows inside the drum and escapes through apertures to prevent a smearing of the ink on the printed sheet. However, this apparatus is more suitable for webs of paper which are guided without fluttering on this apparatus than for sheets of paper. Moreover, such apparatus is more expensive than the other known solutions.

SUMMARY OF THE INVENTION

The invention relates to sheet delivery apparatus for a sheet fed printing press that includes a cylindrical sheet supporting means positioned parallel to the impression cylinder and blanket cylinder of the printing press. The cylindrical sheet supporting apparatus has a shaft journaled in the press frame with a pair of delivery sprockets maintained thereon on opposite sides thereof. Endless delivery chains are reeved about the sprockets and have a plurality of transversely extending gripper bars secured therebetween in preselected spaced relation to each other. The gripper bars have a plurality of grippers and gripper pads which engage the edge of a sheet therebetween. The cylindrical sheet supporting means has a recessed portion to receive the gripper bars as the gripper bars revolve about the shaft. The sprockets have a pitch diameter substantially equal to the diameter of the cylindrical sheet supporting means so that the gripper bar secured to the chains delivered by the sprockets has substantially the same peripheral velocity as the cylindrical sheet supporting means as the gripper revolves about the chain sprockets. A drive means is connected to the printing press drive and rotates the sprockets and cylindrical sheet supporting means in timed relation to the impression and blanket cylinders of the printing press.

The sheet delivery apparatus also includes means to adjust the height of the gripper pads on the gripper bars to engage sheets of different thickness. For the thick sheets the gripper pads have a height so that they follow a path on the pitch diameter of the sprockets and travel at the same peripheral speed as the cylindrical sheet supporting means. For thiner sheets the height of the gripper pads is increased so that the gripper pads extend beyond the periphery of the cylindrical sheet supporting means. In this adjusted position the gripper pads travel in a different path than the periphery of the cylindrical sheet supporting means and hence at a speed faster than the surface of the cylindrical sheet supporting means.

To compensate for the speed and path differential in this latter adjusted position a speed compensating device includes a drive gear for the shaft that is rotatably mounted thereon. The gear has an adjustable eccentric device extending through the drive gear with one end secured to the shaft and the other end connected to an arm member. The arm member has a cam follower positioned in a cam member that is arranged to oscillate the eccentric member during each revolution of the gear and change the angular velocity of the shaft to compensate for speed differences due to the path followed by the gripper pads and their relative radial position.

The eccentric member includes a first shaft axially displaced relative to a second shaft. Adjustment means are provided to adjust the axial displacement of the shafts so that when the shafts are aligned the change in angular velocity is zero and as the axial displacement of the shafts is increased the change in angular velocity is increased. With this arrangement the delivery apparatus can accommodate sheets of different thickness and maintain the same speed of the sheet until the trailing edge portion passes through the nip of the impression and blanket cylinders.

Accordingly, the principal object of this invention is to provide a sheet delivery apparatus in which the path of the front edge of the sheet remains the same as the speed of the trailing edge of the sheet until the sheet trailing edge passes through the nip of the blanket and impression cylinders.

Another object of this invention is to provide sheet delivery apparatus for sheets of different thickness in which the angular velocity of the sheet supporting drum and delivery grippers is periodically changed to compensate for the different path of the sheet and the different speed of the grippers engaging sheets of different thickness.

A further object of this invention is to provide adjustment means to change the angular velocity of the sheet supporting means.

These and other objects and advantages of this invention will be more completely disclosed and described in the following specification, the accompanying drawings and the appended claims.

DESCRIPTION OF THE PREFERRED EMBODIMENTS

Figure 1:
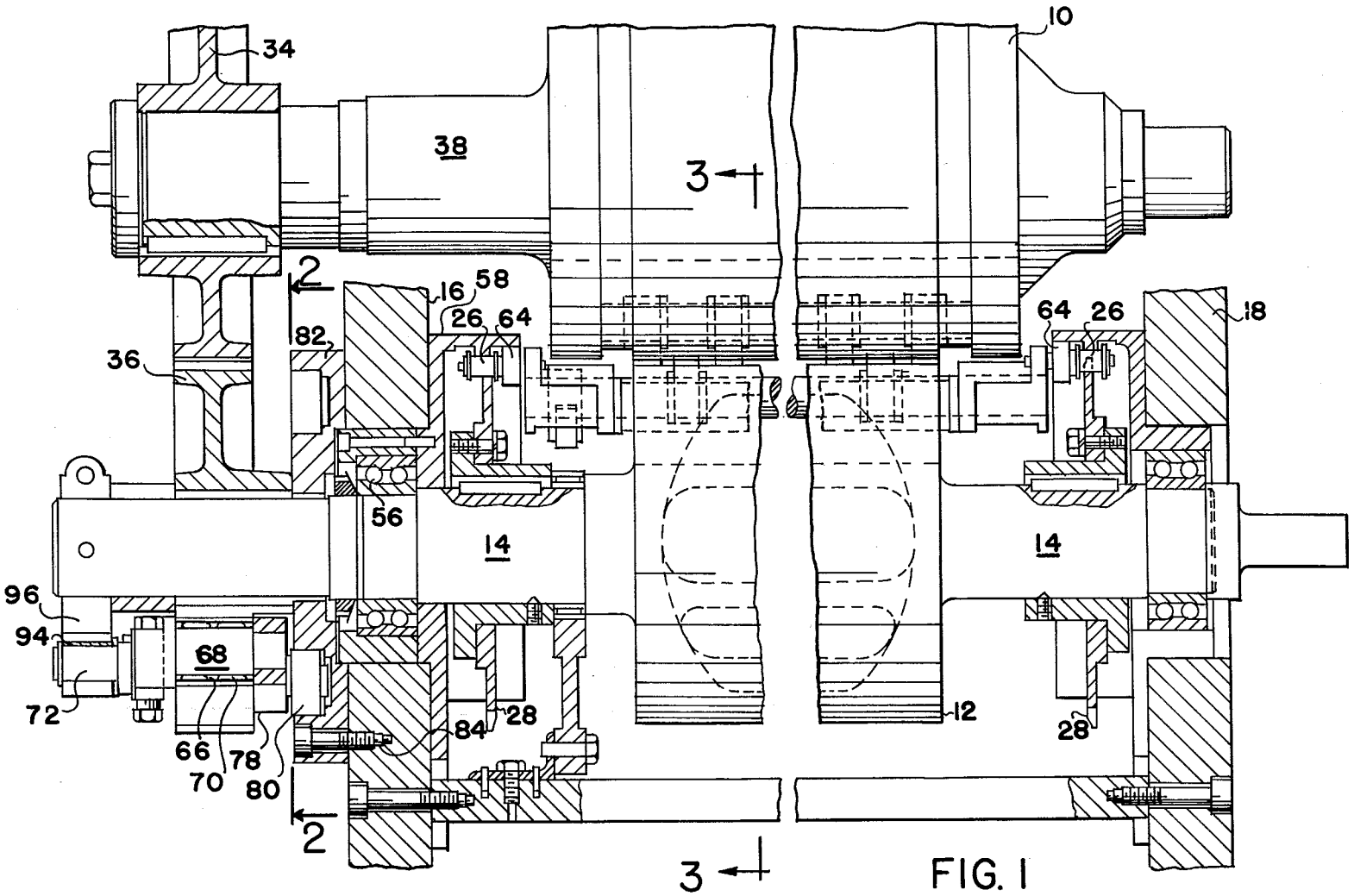
FIG. 1 is a top plan view taken through the delivery drum and the adjacent impression cylinder.
Figure 2:
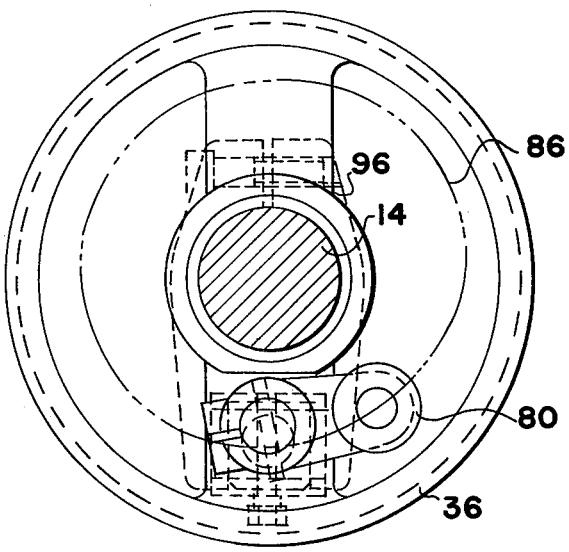
FIG. 2 is a view in section taken along the line II—II of FIG. 1.
Figure 3:
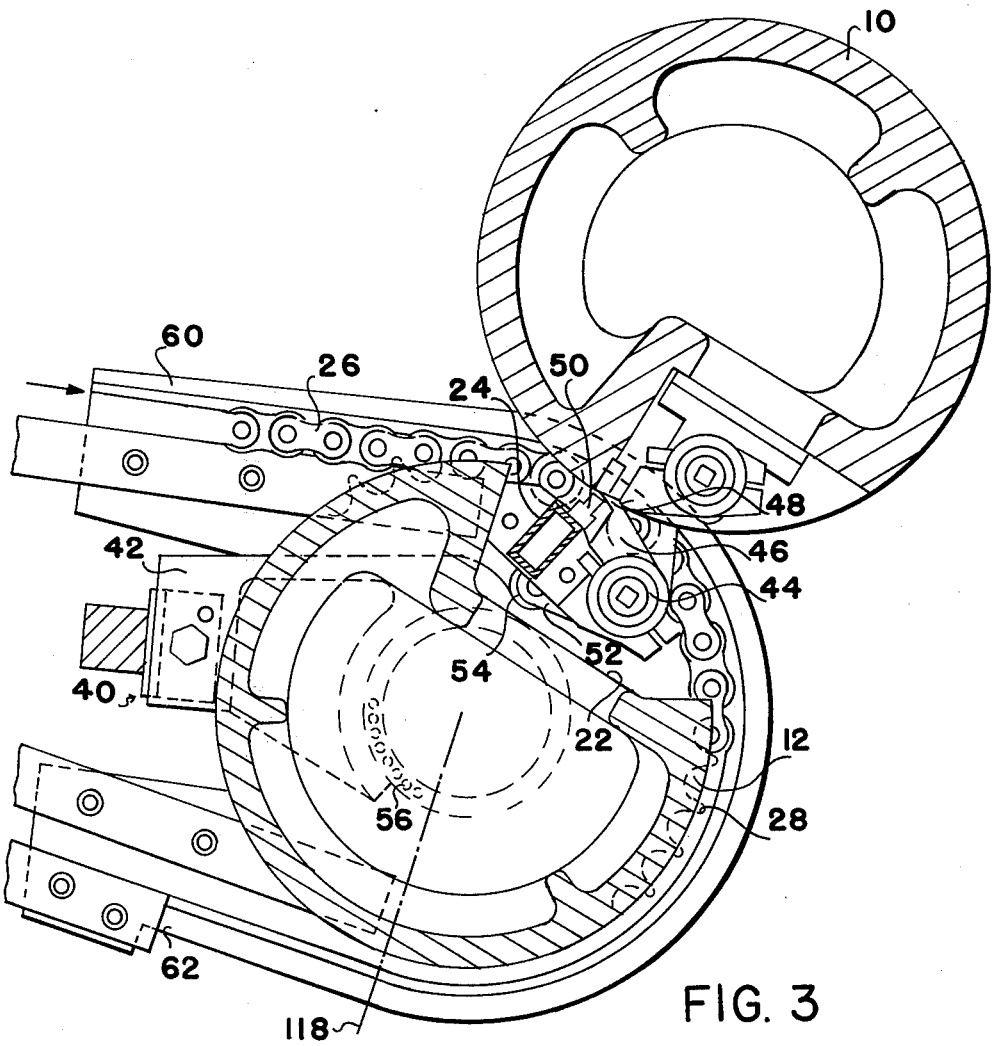
FIG. 3 is a view in section taken along the line III—III of FIG. 1.

Referring to the drawings and in particular to FIGS. 1, 2 and 3 there is illustrated a portion of a printing press that includes an impression cylinder 10 and a delivery drum 12. The delivery drum 12 has a drum shaft 14 suitably journaled in the side frames 16 and 18 of the press. The impression cylinder 10 has a shaft 38 also suitably journaled in the press side frames 16 and 18. The delivery drum 12 is arranged to support a sheet 20 (FIGS. 7, 8, 9 and 10) as it is transferred from the impression cylinder 10. The delivery drum 12 has a recessed portion 22 in which a gripper bar 24 of the sheet delivery apparatus is positioned to engage the leading edge of the sheet 20 while the sheet is positioned on the impression cylinder.

The surface of the delivery drum 12 is suitably treated to provide a surface having controlled roughness and a layer of chromium to support the freshly printed sheet without smearing of the ink on the sheet. The delivery drum 12 may be constructed as a single cylinder or constructed on a plurality of spaced discs on a shaft to suitably support the sheet as it is transferred from the printing unit to the delivery system.

Figure 9:
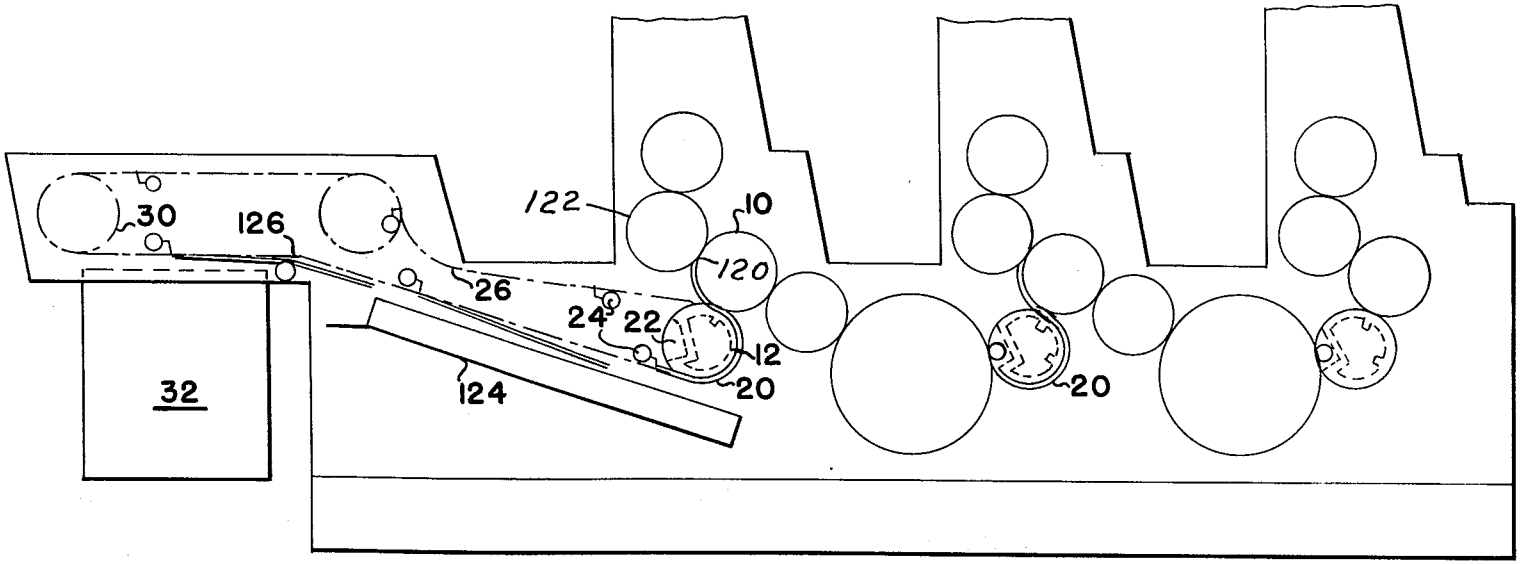
FIG. 9 is a schematic drawing of a high stack delivery apparatus of an offset sheet fed printing press.
Figure 10:
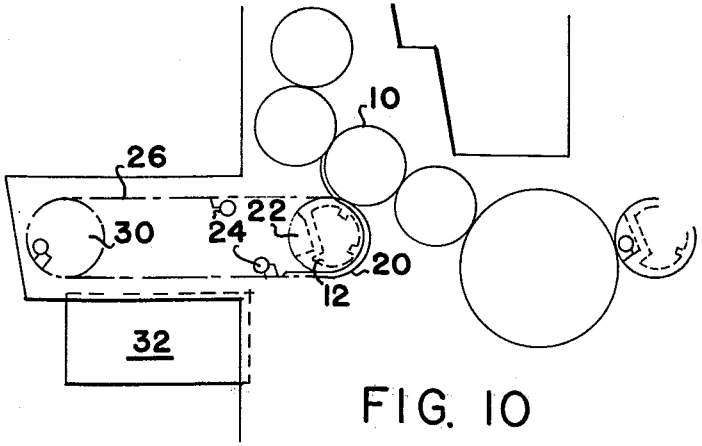
FIG. 10 is similar to FIG. 9, illustrating a low stack delivery apparatus of an offset sheet fed printing press.

The sheet delivery apparatus includes, as illustrated in FIGS. 1, 9 and 10, a pair of endless chains 26 reeved about a pair of drive sprockets 28 connected to the drum shaft 14 and about end sprockets 30 positioned above a stack of sheets 32. The endless chains 26 have a plurality of gripper bars 24 secured to the endless chains in spaced relation to each other. The gripper bars 24 are so spaced on the endless chains 26 that they are positioned within the recessed portion 22 as the grippers on the gripper bars engage the sheets positioned on the impression cylinder 10.

The drive sprockets 28 secured to the drum shaft 14 are driven in timed relation with the impression cylinder 10 by means of meshing gears 34 and 36. The gear 34 is connected to the shaft 38 of impression cylinder 10 and forms a portion of the drive train from the press. With this arrangement the delivery drum 12 is driven in timed relation with the impression cylinder 10. The gear 36 is arranged to rotate at a non-uniform angular velocity by means of an eccentric mechanism later described.

FIG. 3 illustrates the gripper bar 24 positioned in a recessed portion 22 of the delivery drum 12 and a gripper actuator 40 that includes a cam arm 42 suitably secured to the press time. The gripper bar 24 includes a gripper spindle 44 with a plurality of grippers 46 extending therefrom. The grippers 46 each have a gripper finger 48 that is arranged to abut a gripper pad 50 adjustably mounted on the gripper bar 24. A lever 52 is non-rotatably connected to the gripper spindle 44 and has a cam roller 54 that is arranged to rotate and open the gripper 46 to receive the front edge of the sheet between the gripper finger 48 and the gripper pad 50. The cam roller 54 as it passes over a surface of cam arm 42 pivots the gripper arms 46 to move the gripper finger 48 away from the gripper pad 50 and thus open the grippers to receive the front edge of the sheet. Further rotation of the gripper by means of the endless chains 26 moves the cam roller 54 down an inclined surface of the cam arm 42 to close the grippers 46 and engage the front edge of the sheet. Means (not shown) are provided to adjust the height of the gripper pads 50 to engage sheets of different thickness as later discussed.

As is illustrated in FIGS. 1 and 3, the delivery drum 12 is mounted in suitable roller bearings 56 in the press side frames 16 and 18. Chain guides 58, 60 and 62 are provided for guiding the chains. The gripper bars further include end rollers 64 that abut the chain guides 58, 60 and 62 during rotation about the axis of the delivery drum 12. With the hereinafter described relation of the drive sprockets 28 and the delivery drum 12 the chain guides 58, 60 and 62 are located beyond the periphery of the impression cylinder 10.

Figure 7:
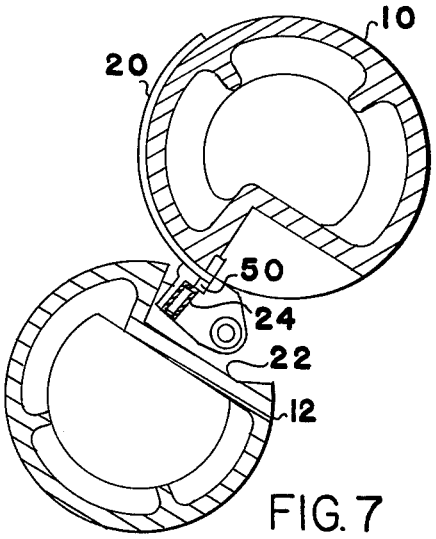
FIG. 7 is a fragmentary view taken along the line III—III of FIG. 1, illustrating the manner in which the gripper pad of the delivery apparatus is positioned for processing thin sheet material.
Figure 8:
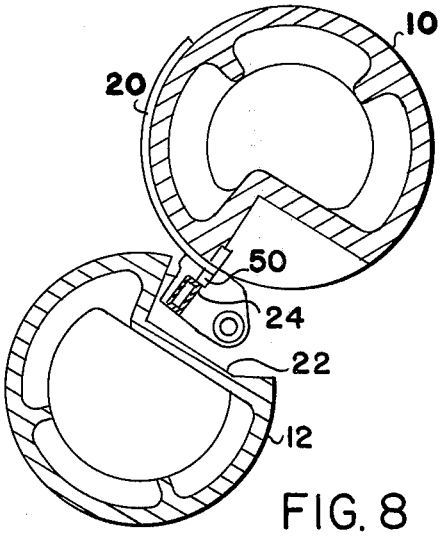
FIG. 8 is a view similar to FIG. 7, illustrating the manner in which the gripper pad of the delivery apparatus is positioned for processing thick sheet material.

The pitch diameter of the drive sprockets 28 is the same as the diameter of the delivery drum 12. FIG. 3 clearly illustrates the outer periphery of the delivery drum 12 and the pitch diameter of the sprockets 28. In FIGS. 3 and 7 the gripper pad 50 of the gripper bar 24 is illustrated as extending beyond the diameter of the delivery drum 12 so that sheets of paper may be delivered without smearing the freshly printed material. FIG. 8 illustrates the gripper pad 50 of the delivery gripper bar 24 positioned so that the radial dimension of the pad is substantially equal to the radial dimension of the delivery drum 12 and also to the pitch diameter of the sprockets 28. Thick sheets are processed with the gripper pad in the position illustrated in FIG. 8.

The above described arrangement of making the pitch diameter of the sprockets equal to the diameter of the drum compensates for previously existing differences in the path traveled by the sheet as it is transferred from the impression cylinder 10 and the difference in speed caused thereby. A slight difference in the path and sheet speed remains when the gripper pad 50 is adjusted beyond the pitch diameter of the sprockets. This slight difference in the path followed ranges from several fractions of a millimeter to a few millimeters measured from the axis of shaft 14 and results from the radial difference between the gripper pad and the pitch circle of the sprockets.

Figure 4:
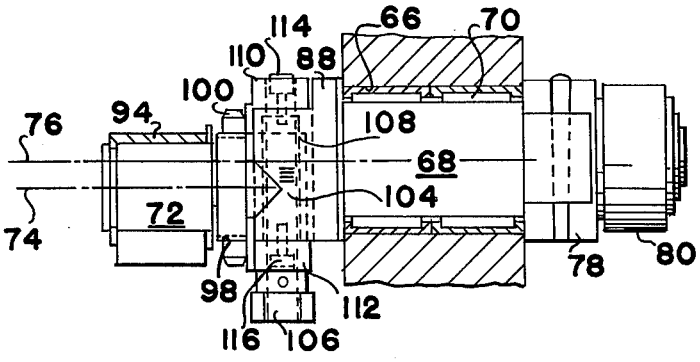
FIG. 4 is an enlarged view in elevation and in section of the adjustable eccentric member illustrated in FIG. 1.

To compensate for these variable and slight differences in the path and speed of the sheet, the gear 36 is rotatably mounted on the delivery drum shaft 14. The gear 36 meshes with the gear 34 that is fixedly connected to the journal or shaft 38 of the impression cylinder 10 and has the same number of teeth as gear 34 to thereby revolve at the same constant speed. Gear 36 has a bore 66 in which a shaft 68 is rotatably mounted on needle bearings 70. As is clearly illustrated in FIGS. 4 and 5, a second shaft 72 with an axis 74 extends laterally from and parallel to shaft 68. As illustrated in FIG. 4, the shaft 72 has its axis 74 displaced from the axis 76 of shaft 68. The shaft 72 has an adjustable eccentricity in relation to the shaft 68 as later explained.

The shaft 68 is connected to a lever 78 that has a roller 80 secured to the end portion thereof. The roller 80 is arranged to abut the cam surfaces of a cam member 82 that is secured to the press side frame 18 by bolts 84 (FIG. 1). The configuration of the surface of cam 82 is illustrated in FIG. 2 by the --- line 86. The cam 82 has a relatively small deflection because the correction required is relatively slight as is illustrated in FIG. 2.

Figure 5:
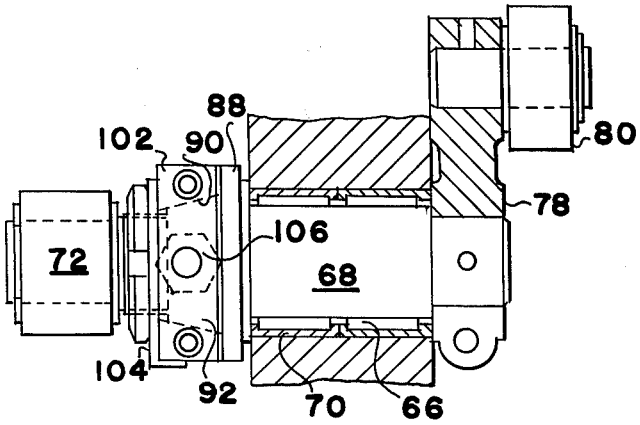
FIG. 5 is a plan view of the adjustable eccentric member illustrated in FIGS. 1 and 4.

The shaft 68, as illustrated in FIGS. 4 and 5, has an enlarged end portion 88 adjacent the shaft 72 and has a dovetail recess 90 in which a mating dovetail end portion 92 of shaft 72 is rotatably positioned. The journal for the shaft 72 rests in a bearing 94 positioned in the clamp 96. The clamp 96 is, in turn, non-rotatably connected to the shaft 14 of the delivery drum 12. Between the portion of the shaft 72 positioned in the bearing 94 of clamp 96 and the dovetail portion 92 the shaft 72 has a threaded portion 98 on which there is positioned a nut 100 frictionally engaging the dovetail portion 92 within the dovetail recess 90 of shaft 68. Between the tension nut 100 and the portion 102 of shaft 68 there is a base plate 104 which is also designed as a graduated indicator.

Figure 6:
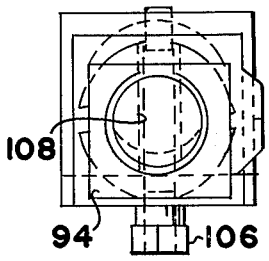
FIG. 6 is an end view of the eccentric member illustrated in FIGS. 1 and 2.

The axis 74 of shaft 72 can be adjusted relative to the axis 76 of shaft 68 by means of an adjusting device that includes a threaded spindle 106, internal threads 108 and covers 110 and 112. The covers 110 and 112 are as illustrated in FIGS. 4, 5 and 6 secured by means of bolts 114 and 116. With this arrangement the axes 74 and 76 of shafts 72 and 68 remain parallel to each other and parallel to the axis of the drum. The axes 74 and 76, however, may be adjusted relative to each other to increase and decrease the eccentricity and thus the variable angular velocity of the gear 36.

The eccentricity between the axes 74 and 76 and the correction in the angular velocity of the gear 36 can be adjusted by means of the graduated indicator 104 depending on the thickness of the paper fed through the press. The gear 36 meshes with the gear 34 and is arranged to rotate at the same angular velocity as gear 34. The shaft 14 of the delivery drum 12 with the sprockets 28 secured thereto is rotatably positioned relative to the gear 36. Rotation from gear 36 is transmitted to shaft 14 through the shafts 68 and 72 and clamp 96. The shaft 68, however, is arranged relative to shaft 72 to vary the angular velocity of the shaft 14 by means of the cam roller 80, lever 78, shaft 68, shaft 72 and the clamp 96.

When the axis 76 of shaft 68 is displaced from the axis 74 of shaft 72 the fixed cam 82 transmits rotation through the cam follower 80 and the other elements of the eccentric to provide a varying angular velocity for the drum 12, sprockets 28 and the gripper 24 connected thereto to thereby compensate for the slight difference in path and speed of the sheet due to sheet thickness. For example, if the axis 74 of shaft 72 is aligned with axis 76 of shaft 68, the eccentricity is adjusted to zero and there is no advance or lag of the delivery drum 12 and chains despite the oscillating motion imparted by the cam 82 and cam follower 80. This is the desired arrangement when the gripper support or pad 50 is positioned as is illustrated in FIG. 8 and extends only to the diameter of the drum 12.

While the length of the lever 78 from the axis 76 of shaft 68 to the axis of the cam roller 80 is much greater than the maximum necessary eccentricity of the compensating eccentric member, only a small fraction of the necessary deflection of the cam 82 is transmitted to the delivery drum 12.

FIG. 3 illustrates that the chains 26 are guided away at tangent point 118 tangentially to the delivery drum 12 and the customary change in direction of the gripper bar and sheet is eliminated. This tangent point 118 at which the sheet leaves the drum or supporting discs is in advance of the point at which the tail end of the sheet leaves the pressure slot or nip 120 between the impression cylinder 10 and the blanket cylinder 122 (FIG. 9).

FIG. 9 illustrates a high stack delivery apparatus in which a trough 124 is positioned below the chains 26. The trough 124 is arranged to provide an air cushion under the sheet so that the sheet is delivered without fluttering. It is apparent from FIG. 9 that the lower chain guide between the delivery drum 12 and the sprockets 30 changes direction only in the region 126.

FIG. 10 illustrates the conditions in an offset rotary sheet fed printing press with a low stack delivery apparatus. With the arrangement no bending or change in direction of the lower chain guide takes place between the delivery drum 12 and the sprockets 30 positioned beyond the stack 32.

As will be apparent from the above apparatus, it is now possible with the pitch diameter of the sprockets equal to the diameter of the delivery drum that the speed of the sheet front edge portion is maintained substantially the same as the speed of the sheet trailing edge portion. With this arrangement the sheet does not experience added tension as it is transferred from the printing unit nor is the speed of the sheet decreased to cause a curl in the trailing edge of the sheet.

Where the gripper pads are adjusted for relatively thin sheets and the speed of the gripper pads differs slightly from the speed of the trailing edge portion of the sheet the eccentric mechanism is operable to compensate for this slight difference in both the path and speed of the sheet.

It is thus now possible to minimize and eliminate the abrupt change in the speed and path of the sheet as it is transferred from the impression cylinder 10 to the grippers on the chain delivery apparatus and further to maintain the speed of the grippers at substantially the same angular velocity as the impression cylinder until the trailing edge of the sheet has passed beyond the nip or pressure point between the impression cylinder and blanket cylinder to thus prevent smearing of the freshly printed sheets.

According to the provisions of the patent statutes, I have explained the principle, preferred construction and mode of operation of my invention and have illustrated and described what is considered to represent its best embodiment. However, it should be understood that, within the scope of the appended claims, the invention may be practiced otherwise than as specifically illustrated and described.

I claim:

1. Sheet delivery apparatus for a sheet fed printing press comprising, a cylindrical sheet supporting member positioned parallel to an impression and blanket cylinder of a printing press, said cylindrical sheet supporting member having a shaft journaled in a press frame, a drive gear rotatably mounted on said shaft, said drive gear having a bore therethrough, means to rotate said drive gear, an eccentric member having a first shaft positioned in said bore and a second shaft axially displaced from said first shaft and nonrotatably connected thereto, clamp means rotatably connecting said eccentric member second shaft to said cylindrical sheet supporting member shaft, a pair of drive sprockets secured to said shaft on opposite sides of said cylindrical sheet supporting member, endless delivery chains reeved about said delivery drive sprockets and having a plurality of transversely extending gripper bars secured therebetween in preselected spaced relation to each other, said gripper bars each having a plurality of gripper fingers and gripper pads arranged to engage the front edge of a sheet therebetween, said cylindrical sheet supporting member having a recessed portion to receive said gripper bars as said gripper bars revolve about the axis of said shaft, an arm member connected to said eccentric member first shaft and having a cam roller mounted thereon, a cam member fixedly secured to said press frame, and said cam member arranged to oscillate said arm member upon rotation of said drive gear to thereby oscillate said eccentric member to rotate said sheet supporting member and vary the angular velocity of said shaft and maintain the speed of said gripper pads on said gripper bars equal to the peripheral velocity of said impression and blanket cylinders until the trailing edge of the sheet passes through the nip of said impression and blanket cylinder.

2. Sheet delivery apparatus as set forth in claim 1 which includes, means to adjust the axial displacement of said eccentric member second shaft relative to said eccentric member first shaft to thereby vary the change in angular velocity of said shaft.

3. Sheet delivery apparatus as set forth in claim 1 which includes, means to guide said delivery chains tangentially away from said cylindrical sheet supporting member.

4. Sheet delivery apparatus as set forth in claim 1 in which said means to adjust the axial displacement of said eccentric member includes, bolt means extending through and threadedly engaged in a transverse bore in said second shaft and rotatably supported on said first shaft so that rotation of said bolt displaces said eccentric member second shaft axis relative to said eccentric member first shaft.

* * * * *